US006875310B2

(12) United States Patent
Beck

(10) Patent No.: US 6,875,310 B2
(45) Date of Patent: Apr. 5, 2005

(54) ROLL CONFIGURATION FOR AN AIR PRESS OF A PAPERMAKING MACHINE

(75) Inventor: David A. Beck, Appleton, WI (US)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 10/397,722

(22) Filed: Mar. 26, 2003

(65) Prior Publication Data

US 2004/0188049 A1 Sep. 30, 2004

(51) Int. Cl.[7] ..... D21F 3/02; D21F 3/08; D21F 11/00

(52) U.S. Cl. ..... 162/205; 162/358.1; 162/360.3; 100/155 R; 100/37

(58) Field of Search ..... 162/205, 206, 162/358.1, 358.3, 358.5, 359.1, 360.2, 361, 360.3, 374; 492/3, 20, 26, 27, 35–40, 47, 48, 57–60; 100/118, 161, 162 R, 155 R, 168–170, 176, 37, 47; 34/113–117, 454, 242

(56) References Cited

U.S. PATENT DOCUMENTS

| | | | | |
|---|---|---|---|---|
| 824,848 A | | 7/1906 | Corwin | |
| 1,837,925 A | | 12/1931 | Thompson | |
| 2,280,208 A | | 4/1942 | Wilkie | 92/49 |
| 2,720,691 A | | 10/1955 | Kuniholm | 29/123 |
| 3,106,767 A | * | 10/1963 | Fox | 492/22 |
| 3,315,370 A | | 4/1967 | Hikosaka | 34/70 |
| 3,804,707 A | * | 4/1974 | Mohr et al. | 162/358.3 |
| 4,173,249 A | | 11/1979 | Holkko et al. | 162/360 |
| 4,675,079 A | | 6/1987 | Webster | 162/360 |
| 4,864,704 A | * | 9/1989 | Hogan et al. | 492/22 |
| 5,564,196 A | | 10/1996 | Nomura et al. | 34/110 |
| 6,287,427 B1 | * | 9/2001 | Beck | 162/360.3 |
| 6,374,494 B1 | | 4/2002 | Sonobe et al. | 29/895.3 |

FOREIGN PATENT DOCUMENTS

| | | | |
|---|---|---|---|
| EP | 0 613 729 A2 | 9/1994 | B05D/1/40 |
| EP | 1 088 933 A2 | 4/2001 | D21F/3/02 |
| EP | 1 088 934 A2 | 4/2001 | D21F/3/02 |

* cited by examiner

*Primary Examiner*—Peter Chin
*Assistant Examiner*—Eric Hug
(74) *Attorney, Agent, or Firm*—Taylor & Aust, P.C.

(57) ABSTRACT

An air press for use in a paper machine removes liquid from a fiber web. The air press includes a plurality of rolls, with each roll having a peripheral surface. The plurality of rolls include at least one pair of adjacent rolls defining a nip therebetween. Each roll in the at least one roll pair has longitudinally opposite replaceable ends. The replaceable ends define a portion of the peripheral surface with the nip therebetween.

20 Claims, 1 Drawing Sheet

ROLL CONFIGURATION FOR AN AIR PRESS OF A PAPERMAKING MACHINE

BACKGROUND OF THE INVENTION

1. Field of the Invention

The present invention relates to air press assemblies of papermaking machines, and, more particularly, to roll configurations used in such air press assemblies.

2. Description of the Related Art

For many years attempts have been made to use external air pressure to force water out of a paper web. Rather than compress a sheet at a press nip to the point where hydraulic pressure drives water out, as is the case in normal wet pressing, it was reasoned that more water could be removed, and sheet bulk could be maintained, if air pressure could be applied to supplement roll nip generated hydraulic pressures. One such attempt involves providing a multi-roll or other structure forming an air press having a closed chamber.

One significant challenge that exists in designing an effective multi-roll air press assembly is in minimizing the leakage of air from the assembly adjacent each set of roll ends, with each set of roll ends at least partially defining a chamber end. Typically, a respective seal assembly is held in tension against each chamber end. However, the opportunity for air leakage from the nip region between respective rolls exists, especially in the end portions of each roll not in contact with the paper web and at least one web transfer fabric being fed therethrough.

Another challenge that exists in designing an effective multi-roll air press assembly is in minimizing the cost, labor and down time associated with the replacement of a worn roll, especially large-diameter main rolls. Even if some type of a surface cover is used in such an instance, replacement involves removing the surface cover from the entire roll length and then placing on a new surface cover. The expense can be increased if the entire roll should instead require replacement.

What is needed in the art is a roll for use in an air press assembly of a papermaking machine that results in decreased air leakage from multi-roll air presses adjacent nip ends thereof, and has readily accessible and replaceable portions which tend to wear for a certain amount of time before any significant wear begins to occur on the primary part of the roll.

SUMMARY OF THE INVENTION

The present invention provides a roll for use in an air press of a papermaking machine which has a hard central section, in order to promote paper web processing, and soft, elastomeric ends, in order to reduce air leakage from the air press.

The invention comprises, in one form thereof, an air press for use in a paper machine for removing liquid from a fiber web. The air press includes a plurality of rolls, with each roll having a peripheral surface. The plurality of rolls include at least one pair of adjacent rolls defining a nip therebetween. Each roll in the at least one roll pair has longitudinally opposite replaceable ends. The replaceable ends define a portion of the peripheral surface with the nip therebetween.

An advantage of the present invention is that the edge portions promote sealing of the respective nips of the plurality of rolls in an air press assembly, thereby reducing air leakage and increasing the effectiveness of the air press assembly.

Yet another advantage is that the size of the edge portions can be chosen such that each edge portion is limited to the area where sealing is required and such that each does not interfere with the conveyance of a fiber web through the air press assembly.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
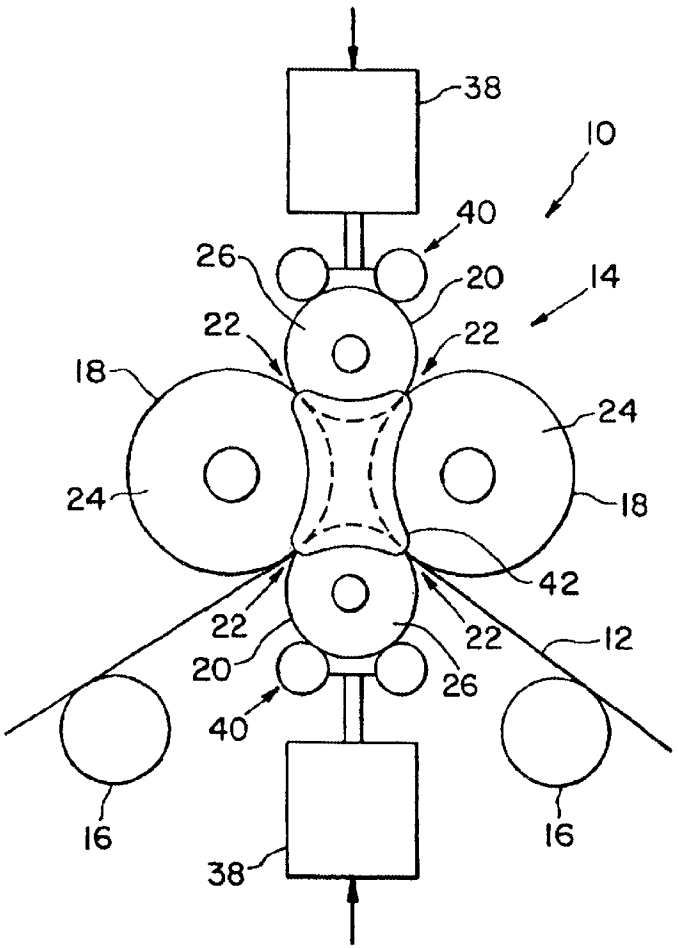
FIG. 1 is a schematic, side view of an embodiment of a papermaking machine of the present invention.

Referring now to the drawings, and more particularly to FIG. 1, there is shown a papermaking machine 10 for processing a fiber web 12 which generally includes an air press 14 and a plurality of conveyor rolls 16, web 12 typically being a paper or board web.

Air press 14 includes a pair of main rolls 18 and a pair of cap rolls 20 juxtaposed thereto, thereby forming a plurality of nips 22 therebetween. At the very edges of main rolls 18 and cap rolls 20 are mounted bevel plates 24 and cap seal rings 26, respectively. Bevel plates 24 and cap seal rings 26 are provided with a beveled notch 28 (FIGS. 2 and 3) and a beveled key 30, respectively, to permit each set of adjoining bevel plates 24 and cap seal rings 26 to matingly seal and thereby interlock main rolls 18 and cap rolls 20 in a cross-machine direction 32. Cap seal ring 26 further has an orthogonal extension 34 that has a pair of adjoining beveled extension ends 36A and 36B configured to mate with adjoining main roll 18 and cap roll 20, respectively.

Air press 14 further includes an air cylinder 38 and corresponding cap seal ring pulleys 40 associated with each cap roll 20; and a dog bone end seal arrangement 42 associated with each of the two collective end sets of main rolls 18 and cap rolls 20.

In the air press arrangement shown in FIG. 1, each roll 18, 20 defines a nip with two other adjacent rolls. In other words, each roll 18, 20 defines a roll pair with two other rolls, totaling four roll pairs of adjacent rolls for air press 14. Of course, the number of roll pairs may vary, depending upon the number of rolls in the air press configuration.

Figure 2:
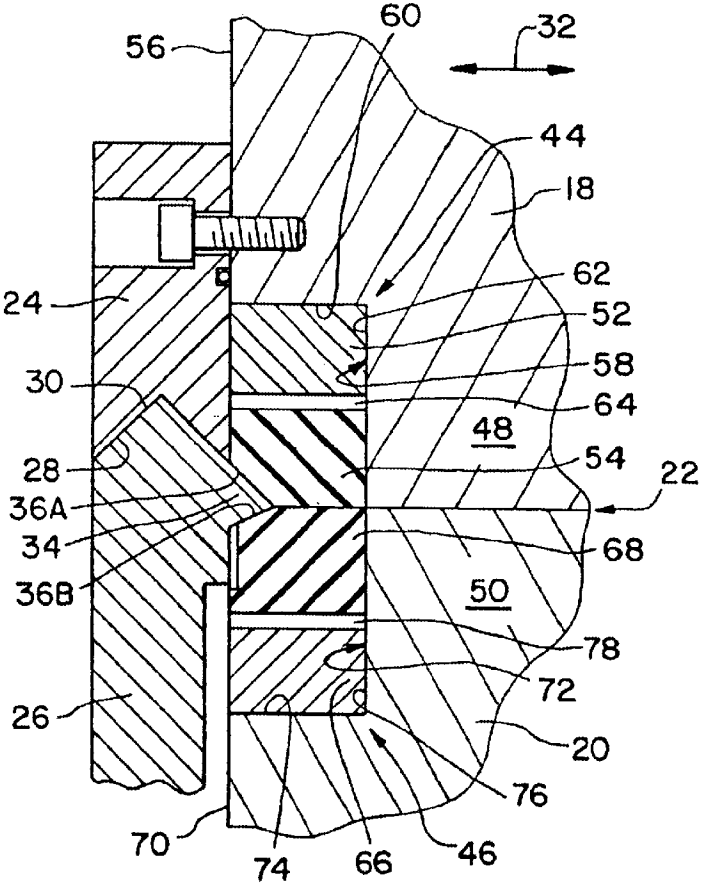
FIG. 2 is a fragmentary, sectional view of a main roll and an adjoining cap roll shown in FIG. 1.

Each roll 18, 20 defining a roll pair includes longitudinally opposite replaceable ends 44 and 46, respectively, with one pair of adjacent replaceable ends 44, 46 being shown in FIG. 2. The replaceable ends 44, 46 at the opposite longitudinal end of main roll 18 and cap roll 20 are substantially the same, and therefore are not shown or described for simplicity sake. Main roll 18 and cap roll 20 each include a middle portion 48 and 50, respectively, extending between replaceable ends 44 and 46. Middle portion 48 and replaceable ends 44 of main roll 18 each have a contiguous peripheral surface defining nip 22. Likewise, middle portion 50 and replaceable ends 46 of cap roll 20 have a contiguous peripheral surface defining nip 22.

Replaceable ends 44 and 46 are configured to provide a higher nip pressure, relative to the nip pressure between middle portions 48 and 50. A higher nip pressure may be effected by the material selection and/or geometrical configuration of replaceable ends 44 and 46.

In the embodiment shown, replaceable end 44 includes a radially inward pulley 52 and a radially outward belt 54. Each longitudinal end 56 of main roll 18 includes a peripheral annular groove 58 defining a shoulder 60 and an axial face 62. Pulley 52 is shrink fitted onto shoulder 60 and abuts axial face 62. Belt 54 is positioned radially outward from and also abuts axial face 62. Pulley 52 includes radially outwardly extending teeth which enmesh with teeth extending radially inwardly from belt 54. This area of enmeshing teeth is shown schematically at area 64 in FIG. 2 since the particular configuration of the teeth may vary from one application to another. The enmeshing teeth prevent relative slipping movement between pulley 52 and belt 54.

In the embodiment shown, pulley 52 is constructed from stainless steel and belt 54 is constructed from rubber; however, pulley 52 and belt 54 may be constructed from other suitable materials to effect a nip pressure at longitudinal end 56 which is greater than the nip pressure between middle portions 48 and 50.

Similarly, replaceable end 46 includes a radially inward pulley 66 and a radially outward belt 68. Each longitudinal end 70 of cap roll 20 includes a peripheral annular groove 72 defining a shoulder 74 and an axial face 76. Pulley 66 is shrink fitted onto shoulder 74 and abuts axial face 76. Belt 68 is positioned radially outward from and also abuts axial face 76. Pulley 66 includes radially outwardly extending teeth which enmesh with teeth extending radially inwardly from belt 68. This area of enmeshing teeth is shown schematically at area 78 in FIG. 2 since the particular configuration of the teeth may vary from one application to another. The enmeshing teeth prevent relative slipping movement between pulley 66 and belt 68.

In the embodiment shown, pulley 66 is constructed from stainless steel and belt 68 is constructed from rubber; however, pulley 66 and belt 68 may be constructed from other suitable materials to effect a nip pressure at longitudinal end 70 which is greater than the nip pressure between middle portions 48 and 50.

Orthogonal extension 34 has a generally triangular cross-sectional shape with an angular geometry which is configured to provide a nip pressure between replaceable ends 44 and 46 which is higher than the nip pressure between middle portions 48 and 50. With nip 22 being positioned in a generally horizontal orientation in FIG. 2, each beveled extension end 36A and 36B is positioned at a predetermined angular orientation relative to the horizontal. In the embodiment shown, beveled extension end 36B engaging belt 68 of replaceable end 46 is at an angular orientation of between 0° to 30° relative to the horizontal, preferably approximately 25° relative to the horizontal. It will be appreciated that the angle chosen affects both the axial and radial components of force which are exerted against belt 68 for sealing. Likewise, the opposing axial component of force which is exerted in an axially outward direction against cap seal ring 26 varies dependent upon the chosen angle of inclination of beveled extension end 36B.

An angle of inclination of beveled extension end 36A engaging belt 54 of replaceable end 44 also affects the radial and axial forces which are exerted against belt 54 and cap seal ring 26. As is apparent, the angle of inclination of beveled extension end 36A shown in FIG. 2 is greater than the angle of inclination of beveled extension 36B relative to the horizontal. These angles may be varied to manipulate the forces applied against belts 54 and 68 to modify the sealing pressure between orthogonal extension 34 and belts 54 and 68.

In the embodiment shown, middle portion 50 of cap roll 20 is rubber covered and belt 68 of cap roll 20 is constructed from a material having substantially the same surface hardness and compression properties as the rubber covering over middle portion 50. For example, in the example shown, belt 68 is formed from cast polyurethane with a durometer of between 50 to 90, preferably approximately 70.

In the embodiment shown, beveled plates 24 are formed from stainless steel and cap seal rings 26 are formed from bronze. Beveled plates 24 and caps seal rings 26 may be formed from other suitable metals, depending upon the particular application.

During use, main rolls 18 and cap rolls 20 are rotated in a complementary manner to feed fiber web 12 through air press 14. Fiber web 12 may simply be fed over the top of bottom cap roll 22, thereby passing through two nips formed between bottom cap roll 22 and each main roll 18. Alternatively, fiber web 12 may travel through a nip adjacent the bottom cap roll 26 and travel around the top cap roll 26 in a generally U-shaped manner to exit air press 14 from the remaining nip defined by bottom cap roll 26. The fiber web does not normally travel through the area defined in the nip between the replaceable ends 44 and 46, but rather travels in the area defined by the nip between middle portions 48 and 50. Water is displaced from the fiber web through a mechanical pressing action effected by air pressure and/or by through air drying resulting from air flowing through the fiber web, depending upon the particular roll configuration of air press 14.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An air press for use in a paper machine for removing liquid from a fiber web, said air press comprising a plurality of rolls, each said roll having a peripheral surface, said plurality of rolls including at least one pair of adjacent rolls defining a nip therebetween, each said roll in said at least one roll pair including longitudinally opposite replaceable ends, said replaceable ends defining a portion of said peripheral surface with said nip therebetween, each said roll in said at least one roll pair including a middle portion extending between said replaceable ends, said replaceable ends being configured to provide a higher nip pressure than said middle portion, said higher nip pressure being effected through at least one of a material selection and geometry of said replaceable ends.

2. The air press of claim 1, wherein each said roll pair includes a main roll and a cap roll.

3. The air press of claim 1, wherein each said roll in said at least one roll pair includes a middle portion extending between said replaceable ends, said replaceable ends having a surface hardness which is approximately the same as said middle portion.

4. The air press of claim 3, wherein said replaceable ends have compression properties which are approximately the same as said middle portion.

5. An air press for use in a paper machine for removing liquid from a fiber web, said air press comprising a plurality of rolls, each said roll having a peripheral surface, said plurality of rolls including at least one pair of adjacent rolls defining a nip therebetween, each said roll in said at least one roll pair including longitudinally opposite replaceable ends, said replaceable ends defining a portion of said peripheral surface with said nip therebetween, each said roll in said roll pair including opposite longitudinal ends with a peripheral annular groove at each end, each said groove defining a shoulder and an axial face, each said replaceable end being positioned in a corresponding said groove adjacent said shoulder and said axial face.

6. The air press of claim 5, wherein each said roll in said roll pair includes a seal ring associated therewith, each said seal ring mounted at a longitudinally outboard end of a corresponding said replaceable end.

7. The air press of claim 6, wherein each said roll pair includes a main roll and a cap roll, said seal ring associated with said cap roll having an orthogonal extension extending partially between said replaceable ends.

8. The air press of claim 7, said orthogonal extension having a generally triangular cross-sectional shape with an angular geometry configured to provide a nip pressure which is higher between said replaceable ends than said middle portion.

9. The air press of claim 5, wherein each said replaceable end includes a pulley adjacent said corresponding shoulder and axial face, and a belt adjacent said pulley and said axial face.

10. The air press of claim 9, wherein each said pulley is a metal pulley affixed to said corresponding roll, and each said belt is an elastomeric belt carried by said correspond pulley.

11. The air press of claim 10, wherein each said pulley is shrink fitted onto said corresponding shoulder.

12. The air press of claim 11, wherein each said pulley is comprised of stainless steel.

13. The air press of claim 10, wherein each said belt is comprised of rubber.

14. The air press of claim 9, wherein each said pulley and each said corresponding belt include enmeshing teeth.

15. A paper machine for making a fiber web, said paper machine comprising:

a plurality of conveyor rolls for carrying the fiber web; and an air press for pressing the fiber web, said air press comprising a plurality of rolls, each said roll having a peripheral surface, said plurality of rolls including at least one pair of adjacent rolls defining a nip therebetween, each said roll in said at least one roll pair including longitudinally opposite replaceable ends, said replaceable ends defining a portion of said peripheral surface with said nip therebetween, each said roll in said at least one roll pair including a middle portion extending between said replaceable ends, said replaceable ends being configured to provide a higher nip pressure than said middle portion, said nip pressure being effected through at least one of a material selection and geometry of said replaceable ends.

16. A paper machine for making a fiber web, said paper machine comprising:

a plurality of conveyor rolls for carrying the fiber web; and an air press for pressing the fiber web, said air press comprising a plurality of rolls, each said roll having a peripheral surface, said plurality of rolls including at least one pair of adjacent rolls defining a nip therebetween, each said roll in said at least one roll pair including longitudinally opposite replaceable ends, said replaceable ends defining a portion of said peripheral surface with said nip therebetween, each said roll in said roll pair including opposite longitudinal ends with a peripheral annular groove at each end, each said groove defining a shoulder and an axial face, each said replaceable end being positioned in a corresponding said groove adjacent said shoulder and said axial face.

17. The paper machine of claim 16, wherein each said roll in said roll pair includes a seal ring associated therewith, each said seal ring mounted at a longitudinally outboard end of a corresponding said replaceable end.

18. The paper machine of claim 17, wherein each said roll pair includes a main roll and a cap roll, said seal ring associated with said cap roll having an orthogonal extension extending partially between said replaceable ends.

19. The paper machine of claim 18, said orthogonal extension having a generally triangular cross-sectional shape with an angular geometry configured to provide a nip pressure which is higher between said replaceable ends than said middle portion.

20. A method of dewatering a fiber web in a paper machine, comprising the steps of:

providing an air press for pressing the fiber web, said air press comprising a plurality of rolls, each said roll having a peripheral surface, said plurality of rolls including at least one pair of adjacent rolls defining a nip therebetween, each said roll in said at least one roll pair including longitudinally opposite replaceable ends and a middle portion extending between said replaceable ends, said replaceable ends defining a portion of said peripheral surface with said nip therebetween, each said roll in said at least one roll pair including a middle portion extending between said replaceable ends, said replaceable ends being configured to provide a higher nip pressure than said middle portion, said higher nip pressure being effected through at least one of a material selection and geometry of said replaceable ends;

forming a nip pressure which is greater between said replaceable ends than between said middle portions; and feeding the fiber web through said nip.

* * * * *